United States Patent [19]

Autry

[11] Patent Number: 4,662,018

[45] Date of Patent: May 5, 1987

[54] FULL SLIP-ON LASTED SHOE CONSTRUCTION

[75] Inventor: James C. Autry, Dallas, Tex.

[73] Assignee: Autry Industries, Inc., Dallas, Tex.

[21] Appl. No.: 747,867

[22] Filed: Jun. 24, 1985

[51] Int. Cl.[4] ..... A43B 9/12; A43B 13/32; A43B 13/28

[52] U.S. Cl. ..... 12/142 RS; 12/142 T; 36/19.5; 36/12

[58] Field of Search ..... 36/12, 14, 19.5, 46.5, 36/47, 45, 49; 12/142 RS, 142 T, 146 C

[56] References Cited

U.S. PATENT DOCUMENTS

| | | | |
|---|---|---|---|
| 1,769,449 | 7/1930 | Meltzer | 36/46.5 |
| 2,428,210 | 9/1947 | Forslund | 36/19.5 |
| 2,549,960 | 4/1951 | Chandler | 36/19.5 |
| 2,554,159 | 5/1951 | Stritter | 36/19.5 |
| 2,746,176 | 5/1956 | Maccarone | 36/12 |
| 2,748,406 | 6/1956 | Stritter | 36/19.5 |

FOREIGN PATENT DOCUMENTS

| | | | |
|---|---|---|---|
| 513144 | 8/1952 | Belgium | 36/19.5 |
| 2123065 | 12/1971 | Fed. Rep. of Germany | 12/142 T |
| 530758 | 6/1955 | Italy | 36/19.5 |
| 544776 | 7/1956 | Italy | 36/19.5 |
| 338754 | 11/1930 | United Kingdom | 36/19.5 |
| 656987 | 9/1951 | United Kingdom | 36/12 |

*Primary Examiner*—Werner H. Schroeder
*Assistant Examiner*—Steven N. Meyers
*Attorney, Agent, or Firm*—Jerry W. Mills; Jefferson Perkins

[57] ABSTRACT

A method of manufacturing a shoe (10) includes joining a toe bottom sock portion (54) on a join line (56) to a toe portion (46) of an upper (12) to form a shoe sock (57). The join line (56) is near toe portion bottom margin (60) and the front perimeter of sock portion (54), and extends from a first side (50) of shoe (10) around the front (51) to a second side (52). A sole (30) is joined to the shoe sock (57) to complete the shoe (10).

1 Claim, 7 Drawing Figures

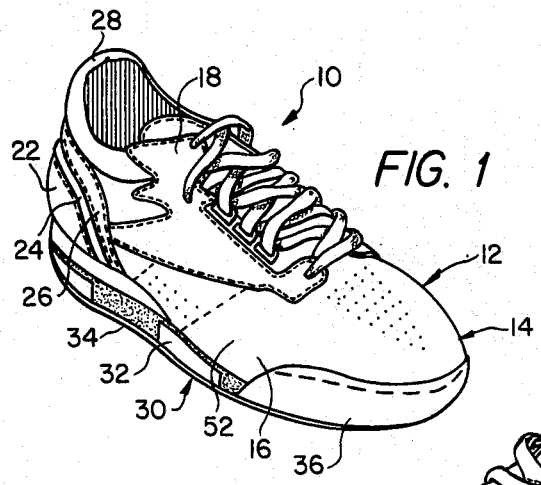
FIG. 1
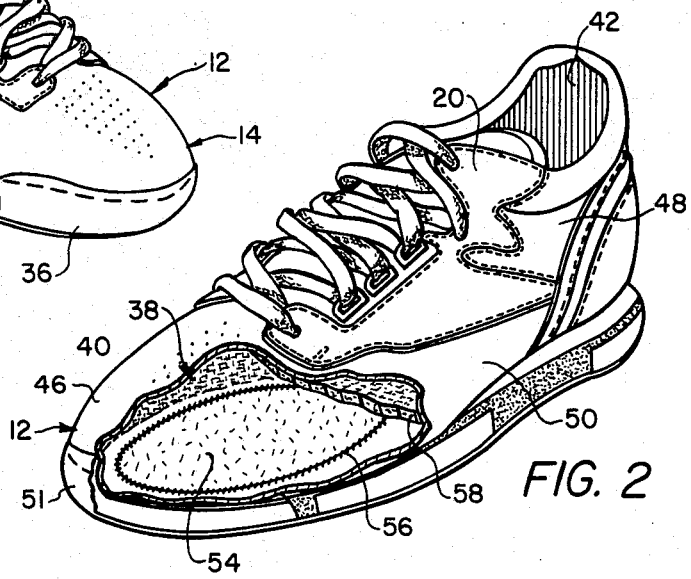
FIG. 2
FIG. 3
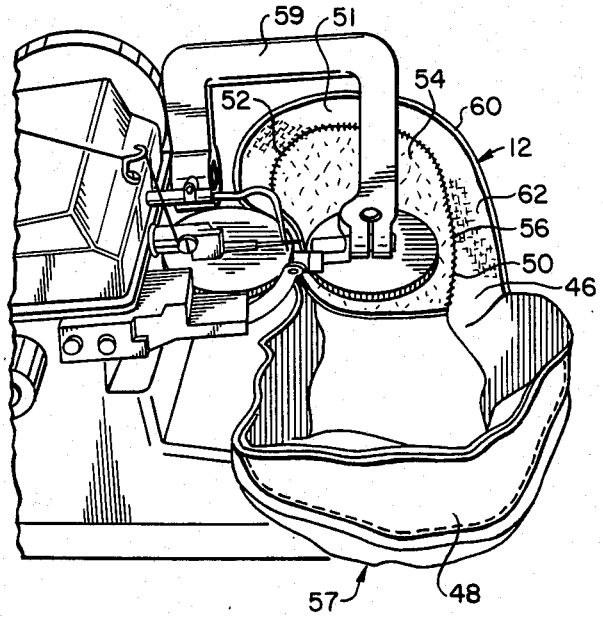
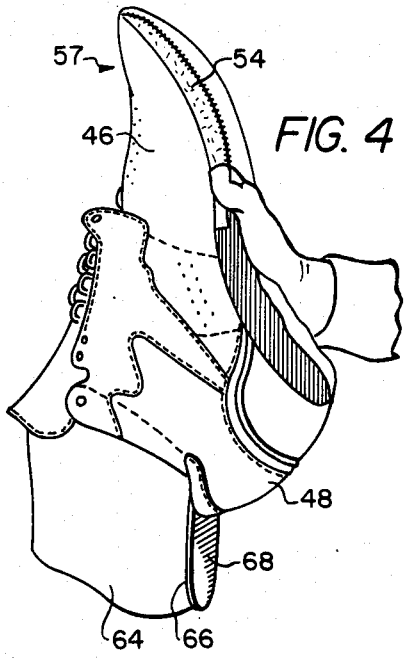
FIG. 4

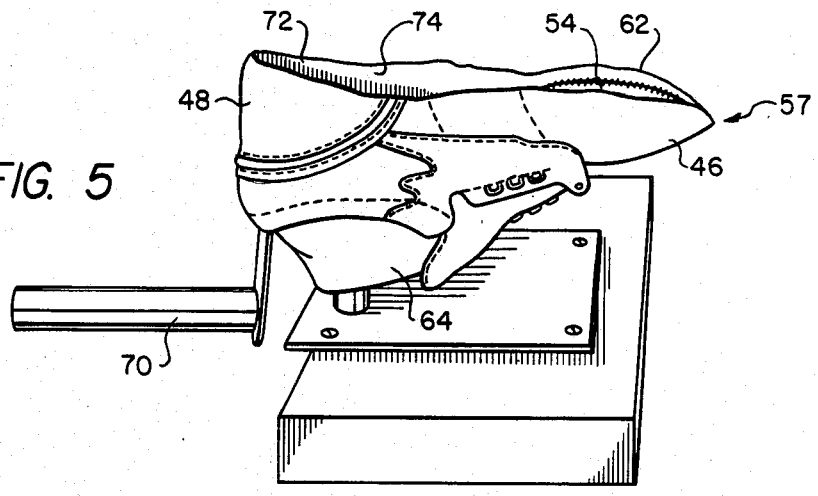
FIG. 5
FIG. 6
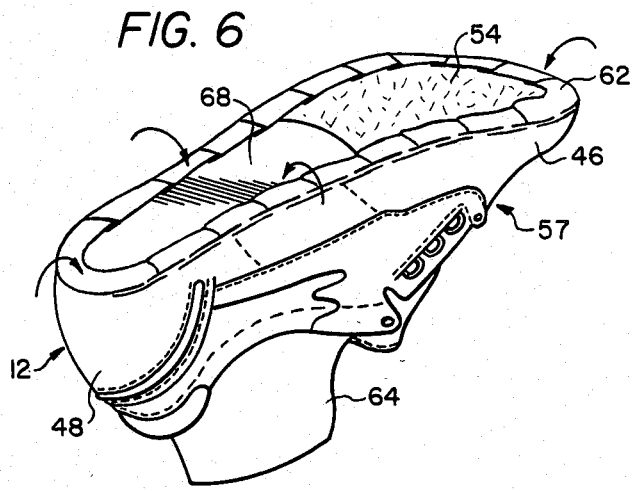
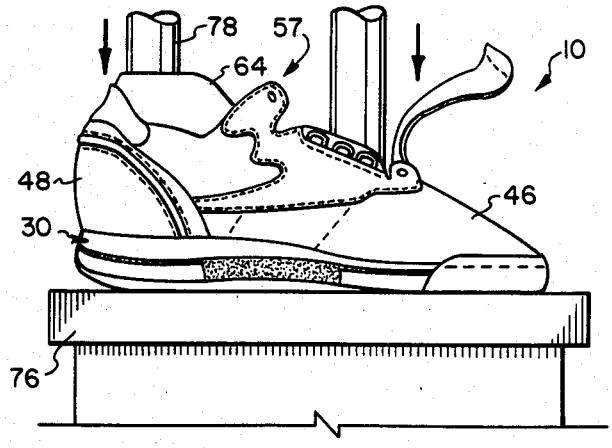
FIG. 7

FULL SLIP-ON LASTED SHOE CONSTRUCTION

TECHNICAL FIELD OF THE INVENTION

This invention relates in general to methods of constructing shoes and shoes produced thereby and more particularly relates to a method for fabricating a full slip-on lasted shoe and the shoe produced thereby.

BACKGROUND OF THE INVENTION

It is known in the art to manufacture shoes by using a last. A full slip-on last construction is known wherein an upper, including a sock disposed on the bottom and extending between the bottom left and right sides of the shoe, is assembled in one piece prior to fitting the upper onto the last. The sock is conventionally provided in two pieces, one-half being joined to one side of the upper, and one-half of the sock being joined to the other half of the leather upper. The sock halves are joined to the leather upper usually by gluing, and an overlap of sock and leather materials is necessary for this purpose.

A central stitch is then made to join the free sock half ends down the center of the sole. Thereafter, the upper is fitted onto a last and a sole is glued or otherwise attached to the upper. The last is then removed from the completed shoe.

Certain problems arise when athletic shoes, and in particular leather athletic shoes, are attempted to be made with the conventional full slip-on last method of construction. First, the last and the sock halves must overlap in three different places; one on the left side of the shoe, one on the right side of the shoe, and one down the middle of the shoe. These three overlaps each require an additional strip of material. Second, the central stitch down the middle of the inner sole will be felt by the wearer. Third, the conventional construction depends on the joint between the bottom sock halves to prevent separation of the shoe sides. The sock must therefore be of a relatively strong woven fabric. There is therefore no opportunity to use cushioning material for the sock portion, such as a nonwoven fabric.

Therefore a need exists in the industry to provide a method of athletic shoe construction whereby the number of overlapping material layers is reduced, thereby saving material costs. Furthermore, a need exists to provide a full slip-on lasted athletic shoe that gives enhanced comfort to the wearer.

SUMMARY OF THE INVENTION

The present invention disclosed and claimed herein discloses a full slip-on last method of shoe construction that provides material savings in constructing the shoe and results in the manufacture of a more comfortable shoe. The method of manufacture includes fabricating an upper of flexible material with an open bottom. A bottom sock portion, which is preferably made of nonwoven fabric, is stitched or otherwise joined across the bottom of the toe portion of the upper on a stitch line which extends from the left side around the front and to the right side. The stitch line is spaced upwardly from the bottom margin of the shoe's toe portion so as to leave a toe lip member.

After the bottom sock portion is joined to the upper, the shoe sock is fitted onto a last. In a preferred embodiment, the last has a texon releasably adhered to its heel portion. The last is fitted into the shoe sock such that the texon is positioned in the heel portion of the upper at a point spaced from the heel bottom margin, thereby defining a peripherial heel bottom lip member similar to the toe lip member. The lip members are then folded over and joined as by gluing to the texon and the sock portion. A sole is then glued to the bottom of the shoe sock, and the completed shoe is clamped between the last and a plate exterior to the sole to provide proper bonding.

BRIEF DESCRIPTION OF THE DRAWINGS

For a more complete understanding of the present invention and the advantages thereof, reference is now made to the following description taken in conjunction with the accompanying Drawings in which:

FIG. 1 is a perspective view of a shoe fabricated according to the method of the invention;

FIG. 2 is another perspective view of the shoe shown in FIG. 1, with the upper and insole broken away to show the stitch line between the sock portion and the upper; and FIGS. 3–7 are views of stages in the method of manufacture used to produce the shoe shown in FIG. 1.

DETAILED DESCRIPTION OF THE INVENTION

FIG. 1 illustrates an athletic shoe 10 manufactured according to the method of the invention. Shoe 10 has a leather upper 12 that is fabricated in this embodiment from a composite of materials. An exterior layer 14 of upper 12 is preferably fabricated of leather out of several components 16–28. These components include a vamp 16, a right quarter 18, a left quarter 20 (FIG. 2), a counter 22 including separate counter strip components 24 and 26 and a top rear portion 28. Components 16–28 are joined as by stitching to form leather exterior layer 14.

Shoe 10 also has a sole 30, including a midsole 32 and an outsole 34. Outsole 34 may have an upstanding toe protector 36. Midsole 30 is preferably constructed of lhtlon, a high ethylene content ethylene vinyl acetate (EVA). Outsole 34, is preferably constructed of natural rubber. Midsole 32 and outsole 34 are joined together as by gluing.

Referring to FIG. 2, upper 12 also has an interior layer 38. In this embodiment, interior layer 38 has a toe portion liner 40 and a heterogeneous heel portion liner 42. Toe portion liner 40 can be constructed of a relatively smooth, comfortable material such as nylon tricot. Heel portion liner 42 is a fabric-backed high density polyurethane foam. Liners 40 and 42 are attached to exterior layer 14 as by stiching and gluing. Upper 12 also includes a counter plate (not shown) between counter exterior 22 and liner 42 which may be made of a relatively stiff thermoplastic.

Shoe 10 has a toe portion 46, a contiguous heel portion 48, a left side 50, a front 51 and a right side 52 (FIG. 1). The bottoms of toe portion 46 and heel portion 48 are constructed differently. In the toe portion, a fabric bottom sock portion 54 extends across the bottom of upper 12 from left side 50 around the front 51 to right side 52. Fabric sock portion 54 is stitched, or joined by other means, along a join line 56 with toe portion liner 40 and leather exterior 14. Join line 56 is near the sides 50 and 52 and front 51 of the shoe, and the margin of sock portion 54, in order to avoid being felt by the wearer's foot. Bottom sock portion 54 is preferably made of a nonwoven fabric material that is more cushionable than woven fabrics. Contrary to previous shoe constructions, stitch line 56 is placed close to sides 50 and 52 such that, in the case where shoe 10 is not provided with an insole, the wearer will not feel the stitch in the middle of his sole.

In this embodiment, an insole 58 is placed inside of upper 12 on top of bottom sock portion 54. Insole 58 may be constructed of such materials as fabric-backed polyurethane foam or lhtlon.

FIG. 3 illustrates a stitching step during the method of manufacturing shoe 10. In FIG. 3, upper 12 has already been assembled from various exterior components 16–28, interior components 40 and 42, and the counter reinforcing element (not shown) which is pliable previous to thermal setting. Before the step shown, upper 12 has a completely open bottom. In accordance with the illustrated fabrication step, bottom sock portion 54 is stitched to toe portion 46 along stitch line 56 to form a shoe sock 57. The stitching may be performed by sewing machine 59 as shown, or may be stitched by hand. Stitch line 56 runs from the middle of the left side 50 around the front 51 to the right side 52, avoiding the central area of sock portion 54 so as not to be felt by the wearer's foot. Stitch line 56 takes an arcuate shape around the front perimeter of sock portion 54 in order to follow the contour of upper 12. Stitch line 56 is spaced from a peripherial margin 60 in a generally uniform manner in order to define a toe lip member 62. When the step shown in FIG. 3 is complete, sock 57 is stitched to cover the bottom of the front half of the upper. The bottom of the heel portion of the upper remains open at this stage.

In FIG. 4, shoe sock 57 is shown being fitted on a last 64 through the foot opening. This method of inserting the shoe last is necessary because bottom sock portion 54 already encloses the bottom of toe portion 46. Last 64 has a heel surface 66. A texon 68 is releasably attached, as by a weak adhesive, to heel surface 66 prior to the insertion of last 64 into shoe sock 57. Texon 68 is made of a tough, durable substance such as leatherized paper, and is provided to extend across and line the bottom of heel portion 48.

FIG. 5 shows the completion of fitting shoe sock 57 onto last 64 with the aid of a shoe horn tool 70. Shoe sock 57 is adjusted on last 64 such that texon 68 is positioned at a point within heel portion 48 so as to be spaced from a peripheral heel portion margin 72. This spacing defines a heel lip member 74, which is on the same order of width as and is generally continuous with toe lip member 62.

In FIG. 6, lip members 62 and 74 are folded inwardly and glued to sock portion 54 and to texon 68. Texon 68 is dimensioned so as to slightly overlap sock portion 54 in the coverage of the bottom of shoe sock 57.

After lip members 54 and 74 have been folded over and glued, sole 30 is glued to the bottom of lip members 62 and 74, sock portion 54 and texon 68. Preferably, the glue covers the entire bottom surface. This is desirable in order to keep sides 50 and 52 from separating from each other or from sole 30. The extra glue however costs much less than the cost of the central fabric overlap found in conventional bottom sock portions.

As shown in FIG. 7, sole 30 is next clamped to shoe sock 57 for drying of the glue by placing sock 57 and sole 30 between a clamping plate 76 and a clamping press 78. Press 78 has suitable attachments to last 64 at the ankle and at the instep in order to apply a uniform pressure between sole 30 and bottom components 54, 62, 68 and 74. This step completes the assembly of shoe 10. Last 64 is removed from shoe 10 after the clamping step, the weak adhesive allowing the last 64 to be easily removed from the texon 68, texon 68 to remain in place.

In summary, a full slip-on last method of manufacturing shoes, such as athletic shoes, has been disclosed, whereby a savings is made in overlapping materials. Further, the shoe produced by method of the invention has a nonwoven fabric bottom sock portion in the place of conventional woven sock portions to provide more cushioning to the plantar surface of the foot. Finally, the method of the invention obviates the need for a central stitch line, making the shoe of the invention more comfortable in instances where an insole is not employed.

Although a preferred embodiment of the invention has been described in detail, it should be understood that various changes, substitutions and alterations can be made therein without departing from the spirit and scope of the invention as defined by the appended claims.

What is claimed is:

1. A method of manufacturing a shoe comprising:

fabricating an upper of flexible, stitchable material, the upper having a toe portion including an open top bottom with a peripheral toe bottom margin;

providing a fabric bottom sock portion for enclosing the toe bottom, the sock portion having a front perimeter;

stitching the sock portion to the toe portion on an arcuate stitch line to form a shoe sock, the stitch line being spaced from and generally parallel to said toe bottom margin, the stitch line defining a peripheral toe lip member having an inner surface and an outer surface;

releasably adhering a bottom heel liner to a heel of a last;

inserting the last and the bottom heel liner into the shoe sock;

positioning the bottom heel liner inside a heel portion of the shoe sock so as to define a peripheral heel lip member having an inner surface and an outer surface;

folding the lip member inwardly over the sock portion and folding the heel lip member over the bottom heel liner;

gluing the inner surface of the lip member to the sock portion and to the bottom heel liner;

gluing a sole to the outer surface of the lip member, the sock portion and the bottom heel liner;

clamping the sole to the shoe sock and bottom heel liner between the last and a plate exterior to the sole; and removing the last.

* * * * *

UNITED STATES PATENT AND TRADEMARK OFFICE

CERTIFICATE OF CORRECTION

PATENT NO. : 4,662,018

DATED : May 5, 1987

INVENTOR(S) : James C. Autry

It is certified that error appears in the above-identified patent and that said Letters Patent is hereby corrected as shown below:

Column 4, line 32, change "top" to --toe--

Signed and Sealed this

Eleventh Day of August, 1987

*Attest:*

DONALD J. QUIGG

*Attesting Officer*

*Commissioner of Patents and Trademarks*